United States Patent [19]

Koreska

[11] 4,177,728

[45] Dec. 11, 1979

[54] METHOD FOR PRODUCING DUPLICATING STENCILS

[75] Inventor: Peter Koreska, Vienna, Austria

[73] Assignee: W. Koreska GmbH, Vienna, Austria

[21] Appl. No.: 569,360

[22] Filed: Apr. 18, 1975

[30] Foreign Application Priority Data

Apr. 26, 1974 [AT] Austria ..... 3462/74

[51] Int. Cl.[2] ..... B41N 1/24; B41C 1/14

[52] U.S. Cl. ..... 101/128.1; 430/308, 101/128.4; 427/143

[58] Field of Search ..... 101/128.2, 128.3, 128.4, 101/127; 427/143; 96/36.4

[56] References Cited

U.S. PATENT DOCUMENTS

| | | | |
|---|---|---|---|
| 3,283,704 | 11/1966 | Dalton | 101/128.2 |
| 3,527,163 | 9/1970 | Bean | 101/128.4 X |
| 3,632,376 | 1/1972 | Newman | 101/128.4 X |
| 3,682,763 | 8/1972 | Kubo et al. | 101/128.2 X |
| 3,871,899 | 3/1975 | Anderson | 101/128.2 X |

*Primary Examiner*—Clyde I. Coughenour
*Attorney, Agent, or Firm*—Ernest F. Marmorek

[57] ABSTRACT

A duplicating stencil comprising a perforated or porous ink-permeable sheet composed of a synthetic resinous film or a metal sheet or film of aluminum or copper. The perforated or porous ink-permeable sheet is coated with a binding agent coating which coating may contain softeners or fillers. On the binder coating there can be applied a coating of hot-seal adhesive which in turn is overcoated with an infra-red light permeable coating. Alternatively, the hot-seal adhesive coating can be applied to a separate sheet of paper, synthetic resinous film or metallic sheet, over-coated with an infra-red permeable coating and placed together with the sheet coated with the binding agent prior to subjection to infra-red rays.

4 Claims, No Drawings

METHOD FOR PRODUCING DUPLICATING STENCILS

BACKGROUND OF THE INVENTION

The instant invention concerns a duplicating stencil for all methods of duplication, as well as a method for producing the duplicating stencil. Furthermore, the instant invention concerns a method for imprinting, or marking such duplicating stencils.

Prior art duplicating stencils usually comprise a paper or a fiber fleece base having an especially porous structure to which the coating is applied. This coating, when subjected to pressure, will then be displaced, or transferred at these locations for example by writing thereon with a typewriter, so that the paper or fiber fleece is exposed with its porous structure. The thusly marked, or imprinted, stencils are pulled over a cylinder which contains the ink, and said ink, by means of rotation, is transmitted to the cylinder wall and penetrates at the locations of the duplicating stencil on which the paper has been exposed through the same and is transmitting the copies in this manner to the normal paper.

Duplicating stencils have also been produced by means of scanning the original in a photo-transmitting apparatus, wherein the developed current impulses for controlling a spark which bridges a spark-gap running from the duplicating stencil synchronously with the original, are utilized. The spark perforates the stencil sheet while passing through the gap so that a duplicating stencil develops, which, under utilization of a duplicating machine, produces copies of the original. This method has the disadvantage in that it is very uneconomical.

A further duplication method, which however does not utilize duplicating stencils of the above-mentioned type, is the so-called thermo-copying method in which the original which is to be duplicated is placed on a dark base which is covered with a white opaque wax-coating; during the exposure to light, the wax-layer melts on the dark locations due to absorption of the long-wave beam and transformation into heat, whereby the dark base becomes visible. According to one embodiment, the base can be provided with a coating of two components which will react under the effect of heat. An example for this are coatings of iron stearate and gallic acid.

A further thermo-copying method utilizes as a base also a porous paper or fiber fleece to which is applied a layer comprising a thermoplastic film-producing synthetic resin. Then, exposed to heat rays, the synthetic resin film shrinks due to the heating and copies of the above-mentioned type can be produced on a prior art mimeograph or duplicating apparatus.

In electrostatic copying methods, which up to this time could not utilize the duplicating stencils, the picture of the original is transmitted via an optic onto an electrostatic loaded selenium drum, which serves as the photo-semiconductor. On those locations to which light is transmitted to the semiconductor drum, the electrical load is lead into the ground, but those locations which correspond with the dark places of the original will remain loaded, and are tinted by means of a toner. The excess toner is removed and the picture is mechanically transmitted to the paper.

In place of the selenium drum there may also be used an electrostatically loaded paper which is provided with a coating containing a semiconductor such as zinc oxide; under exposure of the paper there develops a discharge on those points which are exposed to light. The paper is subsequently developed by means of either a liquid or a powdery toner.

SUMMARY OF THE INVENTION AND DESCRIPTION OF PREFERRED EMBODIMENTS

The instant invention will expand the area of utilization of duplicating stencils to the above-mentioned two methods.

The inventive duplicating stencils comprise a perforated or porous ink-permeable sheet of a synthetic or metallic material which is provided with a coating of a binding agent, if the situation requires, said binding agent may contain additions of a softener and filler agent. If one utilizes a sheet of synthetic resinous material, then especially those of vinyl polymer type, such as polyvinylchloride or polyvinylacetate, or of polypropylene, polyethylene or polyester are preferably selected. If metal sheets are used, such as sheets which comprise aluminum or copper are preferred. Of course, other materials are suitable for the inventive duplicating stencils as long as they can be worked into a sheet having a smooth upper surface.

On the binder coating can be applied a coating of hot-seal adhesive, for example on the basis of mixtures of thermoplastic synthetics with suitable softeners, polymeric vinyl-compositions, acrylates, methacrylates, crotonates, vinylchloride- and vinylester- homo- and mixpolymerisates, especially amorphic thermoplastic ethylene-vinyl-acetate-mixpolymerisates. The hot-seal adhesive coating may also be applied on a separate sheet of paper or synthetic or metallic sheet, which is placed together with the inventive marked stencil-sheet and is then subjected to infrared rays (as described hereinbelow). An infra-red permeable coat is applied over the hot-seal adhesive.

In case where the inventive duplicating stencil is to be utilized for the known sophisticated multiplication method, the binding agent should then be displaceable by utilization of pressure.

The binding agent coating for the thermocopying method may include thermo-sensitive pigments. For the electrostatic copying method, one produces a coating from a binding agent to which is added particles of a semiconductor material, such as zinc oxide.

The perforated sheet of the duplicating stencil may be produced according to a multitude of methods such as, for example, by working salts or pigments into the synthetic resin sheet and obtaining in the first-mentioned sheet the porosity by elimination of the salts. Synthetic sheets with pigments worked thereinto, are being stretched, whereafter they obtain their perforated structure. According to a further method, the synthetic sheet is provided with the desired porosity by means of high-frequency voltage.

A recently developed method for producing perforated sheets consists in having a pulsed laser-beam focused on a synthetic or metallic base.

One has first recognized in connection with the instant invention that perforated synthetic or metallic sheets which were produced by the above-described method can be utilized also for duplicating stencils, if, as mentioned in detail above, such sheets are provided with the respective coating.

The sheets which are perforated according to the prior art methods, are subsequently inventively provided with a coating, which may be thermo-sensitive or contain particles of semiconductor material, such as zinc oxide.

The marking of the inventive duplicating stencil may be made according to all methods, namely, by the mechanical, the thermo- or the electrostatic method, etc.

Thus, in the prior art manner, the inventively produced duplicating stencils, if they are provided with a coating which is displaceable by means of pressure, can be inserted into a common typewriter and typed on.

The inventive duplicating stencils may also be imprinted according to the common imprinting method using ink on the side to be coated, thereafter one proceeds with producing the marked duplicating stencils in a manner so that a hot-seal adhesive coating is applied to the printed coating, and onto the hot-seal adhesive coating is applied an infra-red ray-permeable coating, or by adding a paper or synthetic or metallic sheet which is provided with a hot-seal adhesive coating. If one uses then infra-red rays, then the rays penetrate the infra-red ray-permeable coating and the adhesive coating and are absorbed on the printed dark places. The developing absorption heat causes the hot-seal adhesive to melt and there develops at these places an adhesive-connection between the infra-red permeable coating and the printed dark places. The coated sheet is then pulled off, whereby the imprinted parts of the stencil are torn out and the perforated sheet is exposed at these places. The thusly obtained duplicating stencil may now be utilized for the above-mentioned duplicating method.

In case where the inventive duplicating stencil is to be utilized in thermo-copying methods, then the hot-seal adhesive coating and the infra-red permeable sheet are applied on the stencil, namely, on the coated side thereof, and subsequently the original is placed thereon. Under exposure to infra-red light there results again on the dark places the absorption of the rays of long wave length and the absorption heat causes the infra-red light-permeable coating and the binding agent coating of the duplicating stencil to adhere to each other.

By pulling off the infra-red light permeable coating, the glued particles, as in the above-mentioned method, are torn out of the stencil-coating and one obtains the marked stencil for duplicating purposes.

In the electrostatic method, the original is optically transposed to an inventive, electrostatically loaded stencil having a coating which contains semiconductor particles. On those places which are exposed to light, namely, the light places of the original, there develops a discharge, while the places which correspond with the dark places of the original, remain electrostatically loaded. The picture is developed by means of a toner so that the loaded places are toned dark. The thusly prepared duplicating stencil is then prepared further analogous to the imprinted or marked stencil, i.e., the hot-seal adhesive coating is applied to the coated side of the perforated sheet, and over this hot-seal adhesive coating is placed the infra-red ray permeable coating, or a paper or synthetic or metallic sheet which is provided with a hot-seal adhesive coating. The infra-red rays produce absorption heat on the dark places, whereby said absorption heat leads to the adhesion between the infra-red ray permeable coating and the coating on these places. The infra-red ray permeable layer is torn off and the marked duplicating stencil is ready for use.

Prior art binding agents can be utilized for the inventive markable and imprintable duplicating stencil, such as, for example, pyroxylin waxes, paraffins with admixtures of softeners and/or filler materials; furthermore can be used especially also cellulose ether and cellulose esters, such as ethyl-, methyl-cellulose, nitrocellulose, cellulose-acetate, cellulose-acetate propionates or -butyrates, and ethylhydroxyethylcellulose, vinylpolymers, such as vinyl alcohol, PVC, vinyl acetate- vinylchloride-mixpolymerisates, furthermore styrol-polymerisates, chlorinated polyalkenes, acrylates, latices, for example on an acrylate basis, methacrylate, polyvinylidenechloride polyvinylchloride and mixed-polymers, and the like.

It is important for the selection of the binding agent that on one hand there will result a favorable adhesive connection between the infra-red ray permeable layer and the binding agent, at the heated places and that on the other hand these places can be lifted off also with sharp edges and smoothly from the perforated and porous sheet. To the binding agent can be added therefore also colloids, filler agents, pigments, etc., which will loosen the structure so that a sharp-edged tearing out of the binding agent is guaranteed.

There may also be selected two binding agents which are not mixable with one another.

The coating material can contain zones which are contained microscopically small in the binding agent and will guarantee the freeing of the porous sheet at any random marking.

To the coating material may be added any of the following softeners, such as, for example, oils, stearates, glycols, tritolylphosphate, triphenylphosphate, cresyl-diphenylphosphate, dinonylsebacate, cyclohexyladipate, bis-2-methoxyethylphthalate, esters of monobutylphthalate, and the like.

As may be noted from the above-mentioned, the inventive duplicating stencils open up a multiplicity of additional possibilities of utilization; especially surprising is the possibility of combining the electrostatic- and thermo-copying methods with the stencil copying method. On the basis of the sharply contoured perforation in the synthetic material or the metallic sheets, one obtains extremely precise copies, whereby a so-called "swimming" of the ink is practically eliminated. It is also possible to produce an extremely large number of copies by means of the present invention.

EXAMPLE 1

A perforated sheet of polyethylene is coated by a mixture containing:

| | |
|---|---|
| nitrocellulose | 12 parts per weight |
| $TiO_2$ | 15 parts per weight |
| mineral oil | 30 parts per weight |
| fatty alcohols | 35 parts per weight |

A such coated stencil is marked by type writing. Sharply contoured copies are obtained when the such marked stencil is used in a known copying apparatus.

EXAMPLE 2

A perforated sheet of PVC is coated by a mixture containing:

| | |
|---|---|
| polymeric acetatbutyrate of Cellulose | 15 parts per weight |
| ester of phthalic acid | 8 parts per weight |
| Zu O | 12 parts per weight |
| $TiO_2$ | 7 parts per weight |
| mineral oil | 20 parts per weight |

The such coated sheet is coated by a second layer of a hot-seal adhesive on the base of a PV acetate with plasticisers and the adhesive layer is overlayed by a infrared ray permeable foil of polyethylene. The such obtained stencil is exposed to infra-red rays together with the original to be copied. The foil of polyethylene is removed from the stencil. Sharply contoured copies are obtained when the marked stencil is used in a known copying apparatur.

What is claimed is:

1. A method for producing a reusable, marked duplicating stencil of an original of an image having light and dark portions, comprising the steps of:

preparing a structure including an ink-permeable sheet composed of a plastic material having two major surfaces, and a first layer including a binding material and disposed on at least a portion of one of said major surfaces, said binding material including particles of a semiconductor, establishing an electrostatic charge distribution on said first layer in correspondence to said image;

applying a toner to the electrostatically charged portions of said first layer;

subsequently, applying a second layer consisting essentially of a hot-seal adhesive to at least a portion of said first layer;

applying a third layer consisting essentially of a material substantially transparent to infra-red light to said second layer;

thereafter, subjecting said second layer to sufficient infra-red light to heat up the parts of said second layer corresponding to the dark portions of said image so that the heated parts, upon cooling, become adhered to said first layer; and thereafter removing said second and third layers to obtain said stencil.

2. A method for producing a marked duplicating stencil, comprising the steps of:

preparing a structure including an ink-permeable sheet composed of a plastic material having two major surfaces, and a first layer including a binding material and disposed on at least a portion of one of said major surfaces, applying at least some printing ink onto said first layer;

subsequently applying a second layer consisting essentially of a hot-seal adhesive onto at least a portion of said first layer;

applying a third layer consisting essentially of a material substantially transparent to infra-red light onto said second layer;

thereafter, subjecting said second layer to sufficient infra-red light to heat the parts of said second layer carrying said printing ink so that the heated parts, upon cooling, become adhered to said first layer;

thereafter, removing said second and third layers, whereby said stencil is obtained.

3. A method for producing a reusable, marked duplicating stencil of an original of an image having light and dark portions, comprising the steps of:

preparing a structure including an ink-permeable sheet composed of a metallic material having two major surfaces, and a first layer including a binding material and disposed on at least a portion of one of said major surfaces, said binding material including particles of a semiconductor, establishing an electrostatic charge distribution on said first layer in correspondence to said image;

applying a toner to the electrostatically charged portions of said first layer;

subsequently, applying a second layer consisting essentially of a hot-seal adhesive to at least a portion of said first layer;

applying a third layer consisting essentially of a material substantially transparent to infra-red light to said second layer;

thereafter, subjecting said second layer to sufficient infra-red light to heat up the parts of said second layer corresponding to the dark portions of said image so that the heated parts, upon cooling, become adhered to said first layer; and thereafter removing said second and third layers to obtain said stencil.

4. A method for producing a marked duplicating stencil, comprising the steps of:

preparing a structure including an ink-permeable sheet composed of a metallic material having two major surfaces, and a first layer including a binding material and disposed on at least a portion of one of said major surfaces.

applying at least some printing ink onto said first layer;

subsequently applying a second layer consisting essentially of a hot-seal adhesive onto at least a portion of said first layer;

applying a third layer consisting essentially of a material substantially transparent to infra-red light onto said second layer;

thereafter, subjecting said second layer to sufficient infra-red light to heat the parts of said second layer carrying said printing ink so that the heated parts, upon cooling, become adhered to said first layer;

thereafter, removing said second and third layers, whereby said stencil is obtained.

* * * * *